US006582289B1

(12) United States Patent
Eisenberg

(10) Patent No.: US 6,582,289 B1
(45) Date of Patent: Jun. 24, 2003

(54) FLAP DISC

(75) Inventor: Gustav Eisenberg, Hannover (DE)

(73) Assignee: Vereinigte Schmirgel - und Maschinen-Fabriken AG, Hannover (DE)

( * ) Notice: Subject to any disclaimer, the term of this patent is extended or adjusted under 35 U.S.C. 154(b) by 0 days.

(21) Appl. No.: 09/856,126

(22) PCT Filed: Nov. 5, 1999

(86) PCT No.: PCT/EP99/08494

§ 371 (c)(1),
(2), (4) Date: May 17, 2001

(87) PCT Pub. No.: WO00/30809

PCT Pub. Date: Jun. 2, 2000

(30) Foreign Application Priority Data

Nov. 20, 1998 (DE) ..... 198 53 550

(51) Int. Cl.[7] ..... B23F 21/03

(52) U.S. Cl. ..... 451/548; 451/526; 451/527; 451/529; 451/530; 451/532; 451/533; 451/534; 451/544

(58) Field of Search ..... 451/526, 527, 451/529, 530, 532, 533, 534, 544, 548

(56) References Cited

U.S. PATENT DOCUMENTS 5,752,876 A * 5/1998 Hettes ..... 451/463
6,066,034 A * 5/2000 Hettes et al. ..... 451/466
6,428,406 B1 * 8/2002 Katsuyama et al. ..... 451/526

* cited by examiner

*Primary Examiner*—Joseph J. Hail, III
*Assistant Examiner*—Shantese McDonald
(74) *Attorney, Agent, or Firm*—Flanagan & Flanagan; John R. Flanagan

(57) ABSTRACT

A flap disc consists of a backing plate to whose peripheral zone laminae overlapping like a fan or roof tiles are attached. In order to improve the abrasive effect of such a flap disc using less material and simpler production, the lamellae 10 consist of first lamellae 12, comprising a backing 14, a base bonding coat 15 applied to the backing, a layer of abrasive grain 16 deposited over the base bonding coat 15, and a size coat 18 over the layer of deposited abrasive grain 16, and second lamellae 20, consisting of a backing 22 and a layer 24 with grinding active fillers applied to the backing.

14 Claims, 1 Drawing Sheet

FLAP DISC

BACKGROUND OF THE INVENTION

The invention concerns a flap disc according to the preamble of claim 1.

The invention concerns an innovation in the structure of a flap disc having a circular backing plate with a peripheral zone and lamellae with pairs of spaced apart opposing longitudinal side edges, the lamellae being arranged about and attached on one side of the backing plate successively around the peripheral zone thereof such that one longitudinal side edge of each lamella overlaps the other longitudinal side edge of the next lamella so as to provide the lamellae in an overlapping roof tiles type configuration on the peripheral zone of the backing plate.

A flap disc is known from DE 35 41 347 in which abrasive lamellae are arranged overlapping like roof tiles around the peripheral zone of a flexible backing pad in the form of a circular disc, whereby said lamellae are inserted through radial slits and firmly clamped on the back by a clamping plate. The backing pad and the clamping plate are in the form of metal discs and are connected along their circumference positively or non-positively. The intention of this arrangement is to enable the flap disc to be transported and used as a one piece tool after manufacture.

DE-GM 88 04 148.4 describes a flap disc which consists of a metal support plate onto which abrasive lamellae are bonded in a fan-type arrangement to form an outer ring. The part of the support plate supporting the abrasive lamellae is bent like a truncated cone. The intention of this is to create a favourable ergonomic shape and increase the strength with respect to centrifugal forces.

DE 38 39 238 describes a flap disc with a backing pad onto which abrasive lamellae are bonded overlapping like roof tiles fan-like on an outer ring. The backing pad is preferably formed as a metal disc containing openings which are preferably round. These holes allow the adhesive to flow through to the back. A depression on the back of the pad enhances the adhesion of the adhesive. At the same time, the pad has several notches in the region of the clamping which guarantee a self-locking effect against loosening of the nut upon clamping tightly. This arrangement is intended to create a backing pad which guarantees high operational reliability and is simple to manufacture.

A flap tool is known from DE 40 20 461 which has a support plate provided with a means of fixing which allows it to be mounted on a drive machine, as well as an abrasive disc comprising a backing in the form of a circular disc detachable from the support plate and an abrasive attached to this. The backing consists of a flexible cloth. The connection between the backing and the support plate is formed by a self-adhesive, detachable, Velcro fastening across the entire area. Abrasive lamellae overlapping like a fan and arranged radially are bonded to the backing. The outside diameter of the backing and the abrasive lamellae attached to it is larger than the outside diameter of a support plate chosen depending on the progressive degree of wear of the abrasive lamellae and with a diameter matched to the respective degree of wear; said support plate is provided with a pin in the centre on the abrasive disc side for a central hole in the backing. Through this arrangement it is intended that as much as possible of the abrasive should be used when grinding in corners.

A flap disc for hand-held grinders is known from DE 195 43 597 which comprises a round backing disc with a central fixing device for attaching it to a hand-held grinder and abrasive lamellae overlapping like a fan fixed to the backing disc and extending to or beyond the outer edge of the backing disc. The surfaces of the abrasive lamellae serve as an abrasive surface. The radial outer narrow sides of the abrasive lamellae form the perimeter of the flap disc. At least the narrow sides of the abrasive lamellae are provided with a curing bonding agent which removes material from the object to be machined and extends to the abrasive surface. This arrangement is intended to create a flap disc which exhibits a long service life even when frequently used in areas like angles, corners or similar not easily accessible places.

With the acknowledged flap discs it is known to use abrasive lamellae having a backing covered with a base bonding coat, thereupon a layer of abrasive grain and on the layer of abrasive grain a first size coat and then—applied by way of a very elaborate process—a second size coat over the first size coat. The first size coat is intended to ensure the strength of the abrasive grain layer and can also include $KBF_4$, cryolite or similar grinding active fillers. The second size coat contains grinding active fillers important for the abrasive action of the flap disc.

The task of the present invention is to devise a flap disc of the aforementioned type in such a way that the abrasive action is improved but with a reduced demand on materials and production.

SUMMARY OF THE INVENTION

This task is solved by the present invention which proposes the use of two different types of lamellae for the lamellae of the flap disc: on the one hand, first lamellae including a backing, a base bonding coat over this, a deposited layer of abrasive grain on the base bonding coat and a size coat over the deposited layer of abrasive grain; and on the other hand, second lamellae including a backing and only one layer of grinding active fillers attached to the backing.

So, for example, every second, third, fourth, etc. lamella can be formed like the first lamella or like the second lamella, and the other lamellae formed like the second lamella or the first lamella. Another possibility is alternating groups of first lamellae and groups of second lamellae, whereby the number of lamellae in the groups may be equal or different.

The arrangement according to the invention has the advantage that the lamellae, on the whole, are simpler and less costly to produce, which in turn makes the flap disc less expensive in the end. By providing the grinding active fillers on separate lamellae with only one bonding layer on the backing, which carries the grinding active fillers, this results in a saving of abrasive grain and it is not necessary to apply the grinding active fillers in a second size coat. Apart from that, there are possibilities for improving the degradation behavior of the grinding active fillers compared to an arrangement in a second size coat according to the state of the art. In doing so, it is also possible to increase the amount of the grinding active fillers which are applied without reducing the cutting ability of the flap disc. At the same time, it has been unexpectedly shown that the abrasive action of the flap disc according to the invention has been improved.

BRIEF DESCRIPTION OF THE DRAWINGS

The invention shall be explained in more detail in the following by means of the accompanying drawing which shows an embodiment example.

The drawing shows

DETAILED DESCRIPTION OF THE INVENTION

Figure 1:
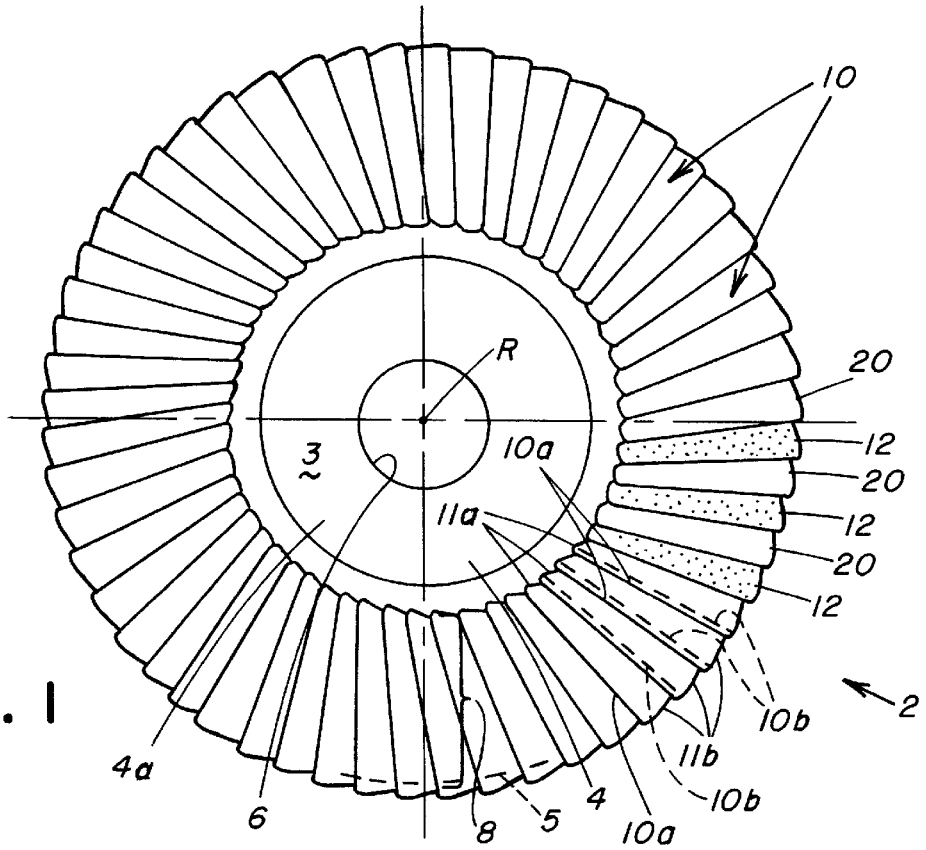
FIG. 1 a plan view of a flap disc.

FIG. 1 shows a flap disc 2 which includes a backing plate 4 of generally circular configuration which has a central through-hole 6 for fixing the flap disc 2 to a machine, a central portion 3 surrounding the central hole 6 and a peripheral zone 8 surrounding the central portion 3 and terminating at an outer circumferential edge 5.

The flap disc 2 also includes lamellae 10. Each lamella 10 has a pair of spaced apart opposing longitudinal side edges 10*a*, 10*b* and inner and outer end edges 11*a*, 11*b* extending between and interconnecting the longitudinal side edges 10*a*, 10*b*. The lamellae 10 are arranged about and attached on one side 4*a* of the backing plate 4 successively around the peripheral zone 8 such that one longitudinal side edge 10*a* of each lamella 10 overlaps the other longitudinal side edge 10*b* of the next lamella 10 so as to provide the lamellae 10 in an overlapping roof tiles type configuration on the peripheral zone 8 of the backing plate 4. Lamellae 10 overlapping in the roof tiles type configuration are fixed, preferably bonded, to the peripheral zone 8 of the backing plate 4 which is arranged perpendicular or at an angle to an axis of rotation R of the flap disc 2. The outer end edges 11*b* of the lamellae 10 end at the circumferential edge 5 of the backing plate 4 or project beyond this and may be formed straight or curved.

FIG. 1 shows a flap disc 2 with a backing plate 4 which has a central through-hole 6 for fixing the flap disc to a machine.

Lamellae 10 overlapping like a fan or roof tiles are fixed, preferably bonded, to the peripheral zone 8 of the backing plate 4 which is arranged perpendicular or at an angle to the axis of rotation.

Figure 2:
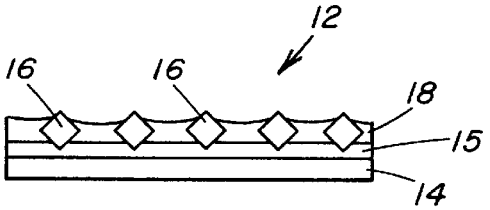
FIG. 2 a section through a first lamella used in the flap disc according to FIG. 1.
Figure 3:
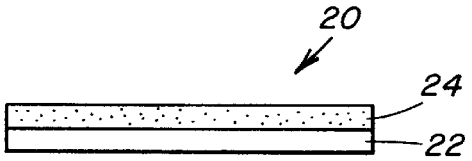

The lamellae 10 include two types of lamellae: first lamellae 12, comprising a backing 14, a base bonding coat 15 on this backing 14, a layer of abrasive grain 16 deposited over the base bonding coat 15, and a size coat 18 over the deposited layer of abrasive grain 16; and second lamellae 20, comprising a backing 22 and on this backing 22 a layer 24 with grinding active fillers, see FIGS. 2 and 3.

The lamellae 10 consist of two types of lamellae: first lamellae 12, comprising a backing 14, a base bonding coat 15 on this, a layer of abrasive grain 16 deposited over the base bonding coat 15, and a size coat 18 over the deposited layer of abrasive grain 16; and second lamellae 20, consisting of a backing 22 and on this backing a layer 24 with active abrasive materials, see FIGS. 2 and 3.

The abrasive grain 16 is in this case partly embedded in the base bonding coat 15 and the thickness of the size coat 18 is chosen so that the peaks of the abrasive grain protrude from the size coat, see FIG. 2.

The first and second lamellae 12 and 20 alternate in FIG. 1. However, it is also possible to form every (n+1)th lamella (n=2, 3, 4 . . . ) as a first or second lamella 12 or 20. Groups of several first and groups of several second lamellae may also alternate, whereby the number of lamellae per group may be different.

This size coat 18 of the first lamella 12 can, additionally, still be provided with grinding active fillers.

The grinding active fillers which are employed are, for example, potassium fluoroborate, cryolite, calcium, fluoride and chiolite.

A number of examples are outlined below to explain the invention further.

EXAMPLE 1

Abrasive lamellae were bonded overlapping like a fan in the known way to a backing disc of 115 mm diameter. Sixty lamellae measuring 18 ×25 mm were employed. The abrasive lamellae consisted of a backing of finished polyester cloth with a base bonding coat in which the abrasive grain was zirconia alumina of grit 40 deposited at a rate of 700 g/m$^2$, a first size coat applied at a rate of 300 g/m$^2$ over the layer of deposited abrasive grain, ensuring the strength of the layer of abrasive grain, and a second size coat with a grinding active filler (potassium fluoroborate), which promotes the grinding process, applied with a bonding agent at a rate of 380 g/m$^2$. This flap disc was tested on a machine at a speed of 4200 rpm, corresponding to a cutting speed of 25 m/s. Circular tubes of V2A 4301 material with an outside diameter of 90 mm and a wall thickness of 10 mm were ground. Over 10 periods each lasting 5 minutes, 153 g of material were removed.

EXAMPLE 2

Abrasive lamellae according to example 1 were bonded to the backing disc, whereby an alternating sequence of lamellae was employed. The 1st, 3rd, 5th, etc. consisted of material as in example 1, but without a second size coat. The 2nd, 4th, 6th, etc. lamellae consisted of a backing onto which only one layer was attached, which contained potassium fluoroborate as the grinding active fillers and was applied with a bonding agent at a rate of 480 g/m$^2$. With the same conditions as in example 1, 373 g of material was removed.

EXAMPLE 3

A flap disc was fabricated according to example 2 which had abrasive lamellae according to example 1 but without a second size coat and contained lamella made from a backing with just one grinding active filler in the ratio of 1:2, i.e. the disc had only ⅓ of the amount of abrasive grain in example 1. With the same conditions as in example 1, this disc removed 353 g of material.

EXAMPLE 4

A flap disc was fabricated according to example 2 but with the potassium fluoroborate grinding active filler replaced by cryolite. With the same conditions as in example 1, this disc removed 394 g of material.

In the example 1–4 the loss in weight of the discs after grinding was approximately equal.

EXAMPLE 5

A flap disc was fabricated according to example 1, whereby sintered aluminium oxide of the same grit was used instead of zirconia alumina. Using this disc under the same conditions as in example 1, 201 g of material was removed.

EXAMPLE 6

A flap disc was fabricated according to example 4 but with sintered aluminium oxide instead of zirconia alumina. Using this disc under the same conditions as in example 1, 370 g of material was removed.

EXAMPLE 7

A flap disc was fabricated according to example 6 but with lamellae which contained calcium carbonate instead of cryolite as the grinding active filler. Using this disc under the same conditions as in example 1, 203 g of material was removed.

In the examples 5–7 the loss in weight of the discs after grinding was approximately equal.

What is claimed is:

1. Flap disc having a backing plate with a peripheral zone and lamellae with pairs of spaced apart opposing longitudinal side edges, the lamellae being arranged about and attached on one side of the backing plate successively around the peripheral zone thereof such that one longitudinal side edge of each lamella overlaps the other longitudinal side edge of the next lamella so as to provide the lamellae in an overlapping roof tiles type configuration on the peripheral zone of the backing plate characterized in that the lamellae (10) include first lamellae (12), comprising a backing (14), a base bonding coat (15) applied to the backing (14), a layer of abrasive grain (16) deposited over the base bonding coat (15), and a size coat (18) over the layer of deposited abrasive grain (16), and a second lamellae (20), comprising a backing (22) and a layer (24) with grinding active fillers applied to the backing (22).

2. Flap disc according to claim 1, characterized in that every (n+1)th lamella (10) (n=2, 3, 4 . . . ) is formed as a first or second lamella (12 or 20).

3. Flap disc according to claim 2, characterized in that the abrasive grain of the flap disc consists of zirconia alumina or sintered aluminum oxide or a mixture of the two.

4. Flap disc according to claim 1, characterized in that alternating groups of first lamellae (12) and groups of second lamellae (20) are provided.

5. Flap disc according to claim 4, characterized in that the number of lamellae per group is equal.

6. Flap disc according to claim 5, characterized in that the abrasive grain of the flap disc consists of zirconia alumina or sintered aluminum oxide or a mixture of the two.

7. Flap disc according to claim 4, characterized in that the abrasive grain of the flap disc consists of zirconia alumina or sintered aluminum oxide or a mixture of the two.

8. Flap disc according to claim 4, characterized in that the number of lamellae per group is different.

9. Flap disc according to claim 1, characterized in that the size coat (18) of the first lamellae (12) is provided with grinding active fillers.

10. Flap disc according to claim 9, characterized in that the abrasive grain of the flap disc consists of zirconia alumina or sintered aluminum oxide or a mixture of the two.

11. Flap disc, according to claim 9, characterized in that the grinding active fillers consist of potassium fluoroborate, cryolite, calcium fluoride or chiolite.

12. Flap disc according to claim 11, characterized in that the abrasive grain of the flap disc consists of zirconia alumina or sintered aluminum oxide or a mixture of the two.

13. Flap disc according to claim 1, characterized in that the grinding active fillers consist of potassium fluoroborate, cryolite, calcium fluoride or chiolite.

14. Flap disc according to claim 1, characterized in that the abrasive grain of the flap disc consists of zirconia alumina or sintered aluminum oxide or a mixture of the two.

* * * * *